US006526629B1

(12) United States Patent
Warner et al.

(10) Patent No.: US 6,526,629 B1
(45) Date of Patent: Mar. 4, 2003

(54) SHOWSHOE WITH CAM LOCK BUCKLE

(75) Inventors: Charles Bentley Warner, San Francisco, CA (US); Daniel T. Emerson, Palo Alto, CA (US)

(73) Assignee: Tubbs Snowshoe Company LLC, Stowe, VT (US)

( * ) Notice: Subject to any disclaimer, the term of this patent is extended or adjusted under 35 U.S.C. 154(b) by 0 days.

(21) Appl. No.: 09/494,324

(22) Filed: Jan. 28, 2000

(51) Int. Cl.[7] ..... A43C 11/00; A44B 11/12

(52) U.S. Cl. ..... 24/71 R; 24/68 A; 24/68 CD; 24/69; 24/170; 36/125

(58) Field of Search ..... 24/71 R, 68 CD, 24/68 A, 69, 170, 909; 36/125

(56) References Cited

U.S. PATENT DOCUMENTS

| | | | | | |
|---|---|---|---|---|---|
| 2,998,628 | A | * | 9/1961 | Prete, Jr. | 24/170 |
| 3,253,309 | A | * | 5/1966 | Baresch | 24/170 |
| 3,413,691 | A | * | 12/1968 | Elsner | 24/170 |
| 4,348,824 | A | * | 9/1982 | Treadwell | 36/125 |
| 4,881,303 | A | * | 11/1989 | Martini | 24/170 |
| 5,172,455 | A | * | 12/1992 | Johnson et al. | 24/170 |
| 5,440,827 | A | | 8/1995 | Klebahn et al. | |
| 5,687,491 | A | | 11/1997 | Klebahn | |
| 5,699,630 | A | | 12/1997 | Klebahn et al. | |
| 5,852,852 | A | * | 12/1998 | Rigal | 24/170 |
| 5,901,471 | A | | 5/1999 | Warner | |
| 5,918,387 | A | | 7/1999 | Emerson | |

OTHER PUBLICATIONS

Cargo Restraint Hardware Brochure of DJ Associates, Inc; Jun. 15, 1997; two pages.

* cited by examiner

*Primary Examiner*—Victor Sakran
(74) *Attorney, Agent, or Firm*—Thomas M. Freiburger

(57) ABSTRACT

A snowshoe having a boot harness assembly includes one or more cam lock type buckles through which webbing straps are tightened. The cam lock buckle allows low friction pulling of the tail end of a strap for tightening, while providing a positive lock against slippage in the opposite direction. A particular configuration of cam lock buckle is disclosed by which friction in tightening the strap is reduced further.

7 Claims, 3 Drawing Sheets

FIG. 2
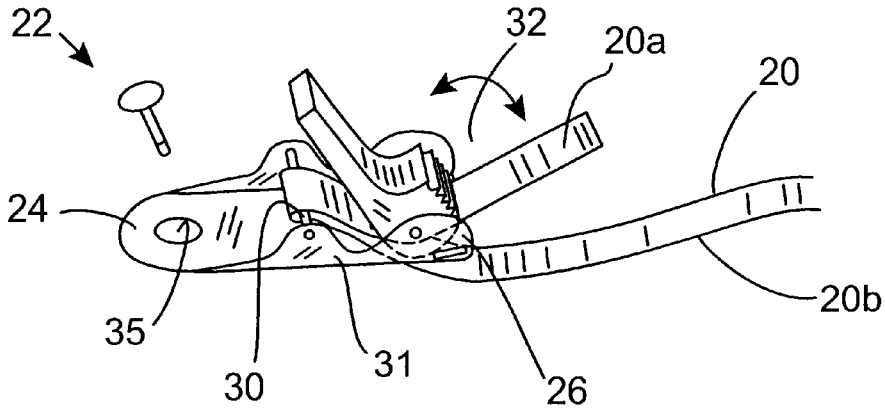
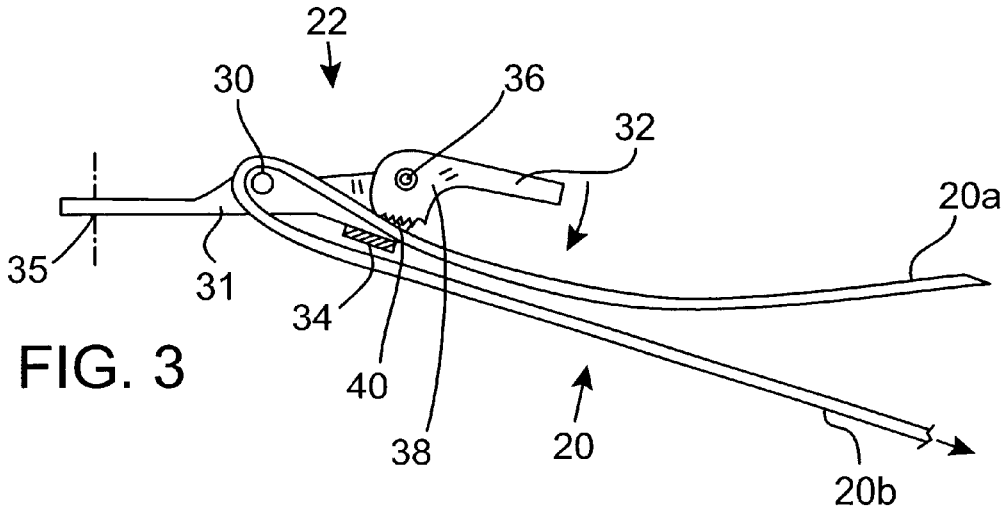
FIG. 3
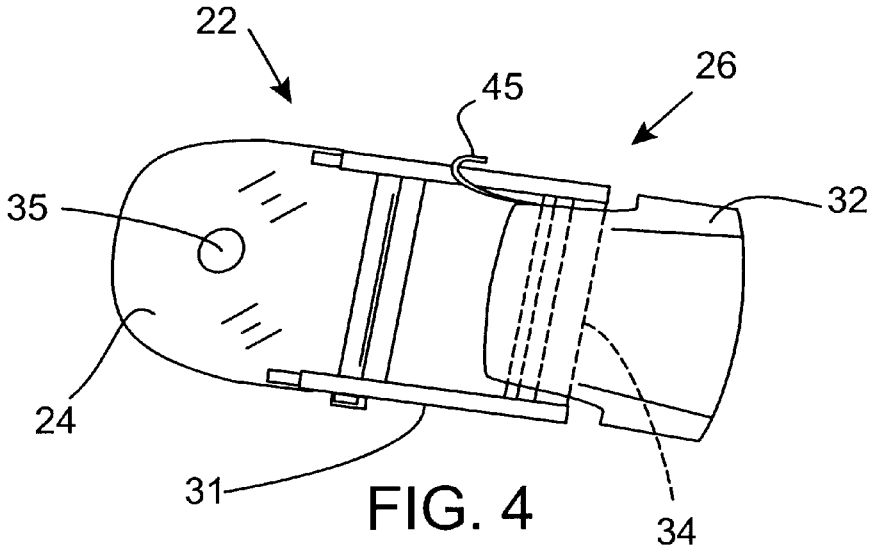
FIG. 4

SHOWSHOE WITH CAM LOCK BUCKLE

BACKGROUND OF THE INVENTION

This invention concerns snowshoes and the manner in which snowshoes are secured to boots of users. Specifically the invention relates to use of a more effective, efficient and lower friction buckle with webbing straps in a snowshoe harness, and to a special design of buckle for achieving low friction tightening regardless of the environment of use.

Snowshoes have some form of harness assembly for securely engaging at least the toe end of a user's boot, normally also including a strap to extend around the heel. Examples of snowshoe harness assemblies are shown in U.S. Pat. Nos. 5,440,827, 5,687,491, 5,699,630, 5,901,471 and copending application Ser. No. 10,199, filed Jan. 21, 1998. A number of snowshoes have webbing type straps in the harness assemblies, formed usually of woven nylon, polyester or other synthetic fibers. These webbing straps are flat, relatively soft and flexible, and have a width of usually about ¾ inch. Most commonly, a ladder lock type buckle is used for engagement with the webbing straps to tighten the harness over a boot. Ladder lock buckles are common in many different contexts and are based on a type of frictional engagement of the strap, which enters through the bottom of the ladder lock buckle, then passes over a crossbar, doubling back and down under another sharply edged crossbar and extending forward as the tensioned portion of the strap, thus engaging the strap against itself beneath the second crossbar. Other buckles or latches have also been used, such as ratcheting buckles where movement of a lever in one direction advances the toothed strap by one tooth each stroke, and release is effected by an extreme movement of the lever. Such straps are relatively rigid, not webbing straps. The latches are not as quick to use as ladder lock buckles, but greater leverage can be achieved in tensioning the harness.

Ladder lock buckles suffer from the problem of high friction. When the tail end of the webbing strap is pulled to tighten the strap by advancing it through the ladder lock buckle, the sharp fold-back of the strap coupled with the usually somewhat ridged or textured surface of the woven strap, the rubbing against the crossbar, and the rubbing of the strap against itself provide considerable friction and require an objectionable degree of pulling force. Accordingly there is a need for a more easily used buckle for webbing straps, one that provides for much lighter pulling force to reach the tension desired in the tension portion of the strap, while also providing for positive locking engagement of the strap in the buckle, preventing slippage.

Cam lock buckles are well known in contexts other than snowshoes. Heavy metal cam lock buckles have been used for large straps for cargo restraint on a truck or trailer, and buckles based on the same principle have found many other uses. The cam lock buckles, sometimes known spring lever buckles, have a lever with teeth which engage against the webbing strap at such orientation and in such a manner that the greater the back-pulling force in the tensioned portion of the strap, the more the teeth engage into the strap and thus the more positive becomes the locking engagement. The back-pulling of the strap through tension causes the spring lever to tend to pivot more firmly toward the strap and a cross bar beneath the strap, the principle by which the tension causes the teeth to engage more positively into the strap. Some of these cam lock buckles have a generally nautilus-shaped hub, with varying radius and the teeth located at the area of greatest radius. Typically in these cam lock buckles the strap is doubled back over the same bar toward which the spring lever is biased, causing relatively high friction at this doubling over location, friction to be overcome when the strap is to be tightened.

SUMMARY OF THE INVENTION

In the invention a snowshoe has a harness with webbing straps, and for tightening the straps and harness on a user's boot, the strap or straps are fitted with at least one cam lock buckle.

The buckle is connected at one end to the harness and has a second end through which passes a webbing strap to be tightened, with the webbing strap being doubled back through the buckle to provide a tail of the strap for gripping and pulling to tighten the tension portion of the strap leading to the buckle.

The cam lock buckle or spring lever buckle has a spring loaded pivoted lever with engagement teeth on a lower or strap-facing side or edge positioned to engage against the tail of the webbing strap. The buckle includes a cross bar toward which the teeth of the lever are urged such that the tail of the strap passes between the teeth and the bar. In use of the strap and buckle, the webbing strap tail can be pulled through the second end of the buckle freely, forcing the lever to pivot away from the surface of the strap tail against the spring force while the tensioned portion of the webbing strap is pulled tighter to tighten the harness. When pulling force on the strap tail is discontinued, back-pulling force from the tensioned portion of the strap tends to draw the lever more tightly against the strap tail, biting the teeth into the surface of the strap more firmly and thus positively gripping the webbing strap in the buckle and preventing slipping.

In one preferred embodiment the buckle has a direction reversal pin or bar adjacent to and spaced from the spring loaded pivoted lever, between the lever and said one end of the buckle. The webbing strap passes around and over the reversal pin and doubles back such that the strap tail passes between the lever and the cross bar, the reversal pin having a low-friction surface relative to the webbing strap. By this construction, friction in tightening the strap is greatly reduced.

In another preferred embodiment the cam lock buckle is simpler, preferably all plastic with a plastic lever pivotally secured to a plastic frame or base. Teeth preferably comprising lateral ridges on the edge of the lever bite into the strap by spring force, engaging more tightly into the strap when the back-pulling force is present.

It is thus among the objects of the invention to improve the efficiency and ease of use of strap tightening buckles on snowshoes, as well as to provide a particular configuration of cam lock or spring lever buckle which provides for very low friction use. These and other objects, advantages and features of the invention will be apparent from the following description of a preferred embodiment, considered along with the accompanying drawings.

DESCRIPTION OF THE DRAWINGS

FIG. 2 is a perspective view showing a particular embodiment of the buckle in greater detail, connected to a webbing strap.

FIG. 3 is a side elevation view partially in section showing the buckle and strap of FIG. 2.

FIG. 4 is a plan view showing the buckle in accordance with the invention.

DESCRIPTION OF PREFERRED EMBODIMENTS

Figure 1:
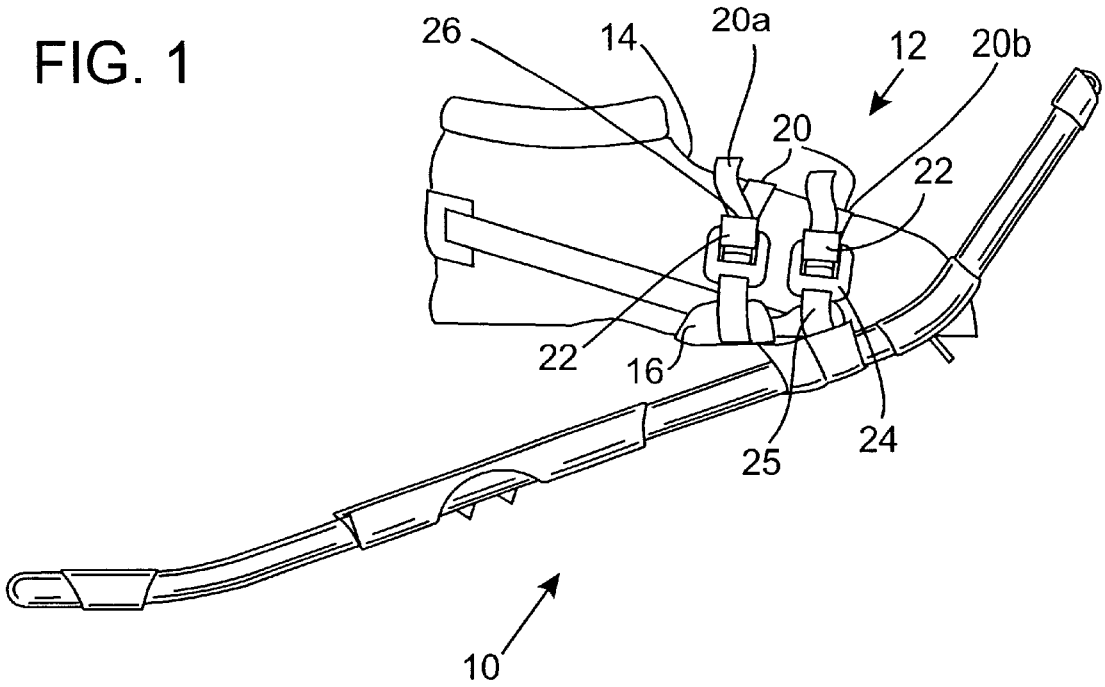
FIG. 1 is a side view showing a snowshoe with a harness assembly and showing the use of a buckle in accordance with the invention.

FIG. 1 shows a snowshoe 10 of the general type disclosed in patents referenced above. The snowshoe 10 has a harness assembly 12 for securing a user's boot 14 to the snowshoe, the harness including left and right harness web portions 16 which are to be drawn toward one another for engaging the boot. Webbing straps 20 are used to draw the harness tight. Webbing straps are as defined above, flat flexible straps, usually woven of synthetic fibers but possibly of other non-rigid materials.

Typically in conventional harness arrangements the webbing straps would be engaged through ladder lock buckles, of the type having several rungs which the straps would travel over and under in such a way as to create a high friction against back-slippage of the straps. Nonetheless, some such slippage could occur.

In the snowshoe shown, a webbing straps 20 passes through buckles 22 of the invention. A first side 24 of the buckle is normally fixed in position, and this can be from a fixed length of webbing strap 25, which is in turn secured to a part of the harness shell or web 16, or this first end can be staked directly to the harness shell, as by riveting. At the second end 26 of the buckle, the strap 20 passes through the buckle forming a tail 20*a* of the strap, pulled by the user to tighten the webbing over the boot. A tension portion 20*b* of the strap pulls the harness shells toward one another to engage the boot.

FIG. 2 shows the buckle 22 of the invention in perspective. The strap 20 is shown entering the buckle from the bottom side, then passing up and over a direction reversal pin 30 which forms an important feature of this embodiment of the buckle of the invention. The pin, dowel or other crossbar 30, having a low friction surface relative to the webbing strap, is located between the first and second ends 24 and 26 of the buckle, secured to the buckle's frame or base 31 and spaced back from a spring loaded locking lever 32 of the buckle. The strap 20 passes over the direction reversal pin or crossbar 30, then forward through the second end of the buckle, passing between the spring loaded lever 32 and a stationary bar 34 (FIG. 3) against which the lever acts to engage the strap between. FIG. 3 shows the strap in cross section and its relationship to the buckle. FIG. 4 shows the buckle alone.

FIGS. 2, 3 and 4 show a buckle 22 construction that provides for direct staking to the harness, rather than providing for connection via a connecting strap 25 as in FIG. 1. Either type of connection can be used, but FIGS. 2–4 show a hole 35 in the first end 24 of the buckle frame, for direct riveting to a snowshoe harness or other item.

As shown particularly in FIG. 3, the buckle 22 of the preferred embodiment has a cam lock engagement with the strap. The lever 32, which preferably is of molded plastic, is pivoted at an axis comprising a metal pin 36, and has a hub 38 preferably with a varying radius. One form of such varying radius is a spiral or nautilus shape in cross section, shown in FIG. 3, wherein strap engaging teeth 40 are at a maximum radius on the hub, but the hub radius tapers down smaller in the direction to the left, or clockwise as seen in the drawings. Thus, when the lever 32 is pivoted up, in a counterclockwise direction around the axis 36, it opens a greater space between the hub 38 and the stationary cross bar 34, allowing a strap to pass freely through. Such pivoting is against the force of a spring, a portion of which is shown at 45 in FIG. 4, but the strap's tail 20*a* is easily pulled to release the cam lock because such pulling force has a tendency to rotate the hub and lever in the counterclockwise direction (as viewed in the drawing), and even a small rotational movement will open the gap wider between the hub 38 and the cross bar 34.

As in known cam lock or spring lever type buckles, the teeth 40 preferably are oriented obliquely in the direction of engaging the strap's surface to resist back-pulling by the tension section 20*b* of the strap, which tension urges the teeth more firmly into the strap, tending to rotate the lever clockwise in FIG. 3.

An important feature of the buckle 22 as noted above, is the strap direction reversal pin or bar 30. Prior similar cam lock buckles have been made without any such direction reversal pin, with the stationary cross bar 34 at the second end of the buckle being relied upon directly for reversal of the strap and to accept the pulling force of tightening the strap. This cross bar 34 on conventional such buckles typically is a flat, blade-like element, and a webbing strap which has lateral surface grooves o texture, as is typical, experiences a high degree of friction resistance to this pulling of the tail end. The greater the tension, the harder this strap bears against the edge of the cross bar 34, and thus the greater resistance to tightening. The buckle of the invention overcomes this problem by providing a low friction surface on a pin or bar 30 which is spaced back from the strap engagement lever 32, thus always providing a smooth transition in reversal of the strap, particularly during pulling of the strap's tail 20*a* to secure the strap tightly.

Figure 5:
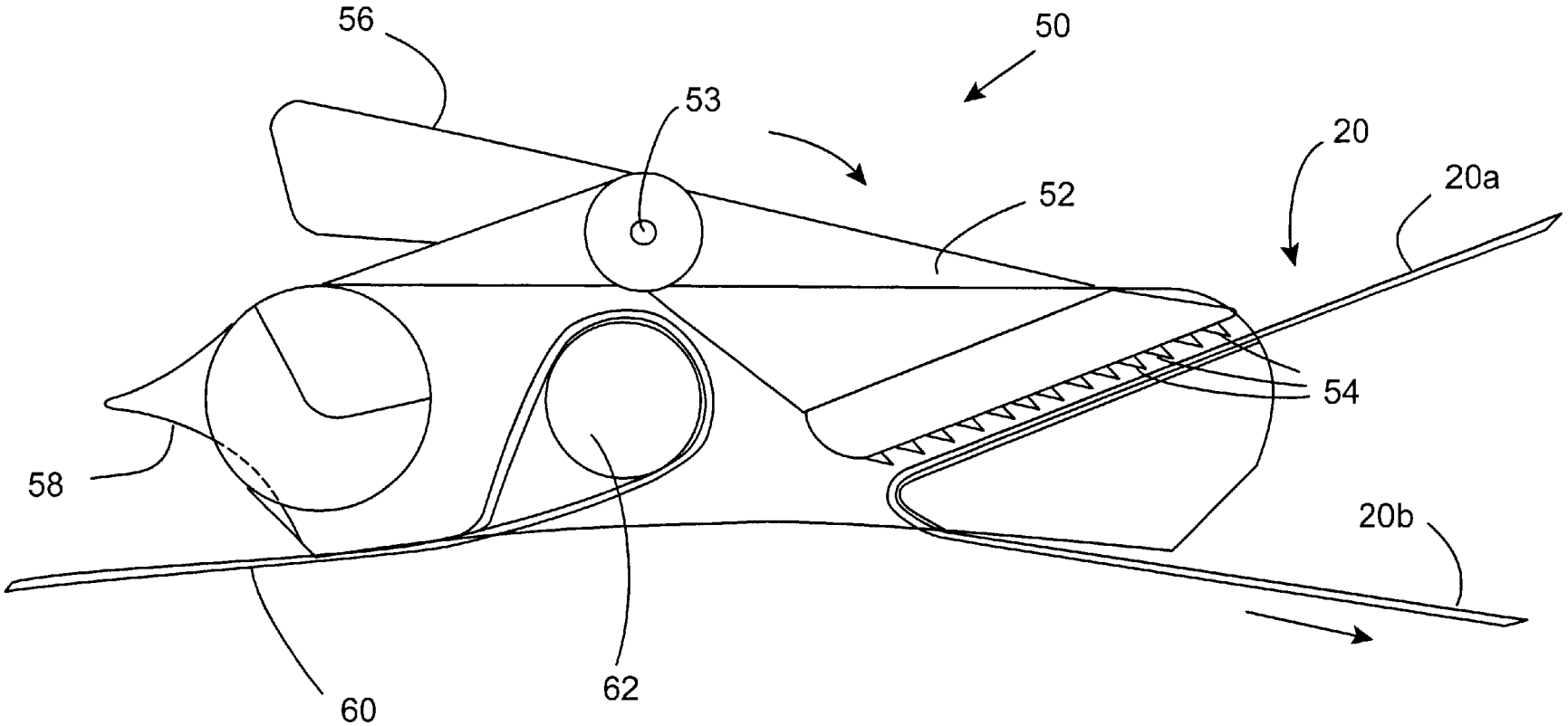
FIG. 5 is a side view showing another form of buckle according to the invention.

FIG. 5 shows another embodiment of a cam lock buckle 50, based on a slightly different principle. The back-pulling tension in the tension portion 20*b* of the strap 20 in this embodiment has a tendency to rotate the buckle's lever 52 about an axis 53 in a direction (clockwise in FIG. 5) to engage the lever's teeth 54 more firmly into the strap, as above. In this embodiment, however, a wide and planar array of angled teeth 54 is relied on to engage into the surface of the strap, rather than a varying-radius pivoted hub having teeth on its surface as in FIGS. 2–4. The buckle 50 has comfortable thumb and finger gripping surfaces 56 and 58. An anchoring strap 60 is shown engaged around a dowel 62 of the buckle.

Figure 6:
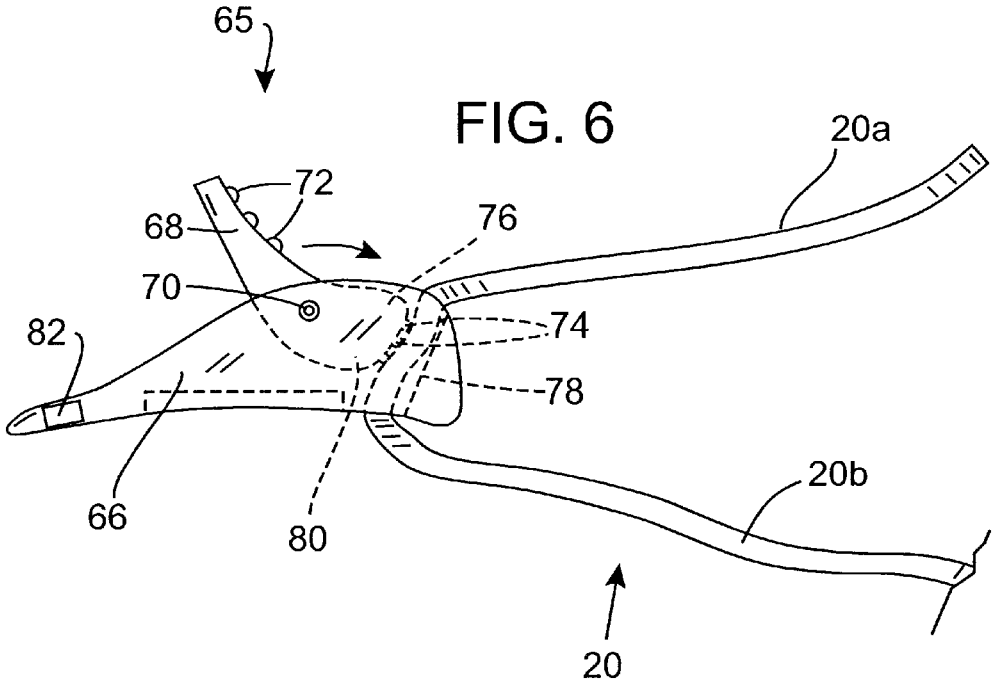
FIG. 6 is a side view showing another form of buckle for use with the invention.

FIG. 6 shows another embodiment of a cam lock buckle 65 which is advantageously used in the snowshoe attachment arrangement of the invention, as a substitute for the cam lock buckle 22 shown in FIGS. 1–4. The cam lock buckle 65 includes a frame or base 66 and a locking lever 68, both of which preferably are formed from injection molded plastic. The lever 68 is pivoted on the frame 66 via an axis comprising a preferably metal pivot pin 70, and is biased by a spring (not shown) in the clockwise direction relative to the frame as viewed in the side view of FIG. 6.

In many respects the cam lock buckle 65 is typical of known cam lock buckles, particularly in its manner of operation. The cam lever 68 preferably has several ridges 72 for thumb gripping, and at its opposite end, at least one and preferably about three laterally extending ridges 74 are provided as teeth for engaging against the snowshoe strap 20. The end of the lever having the ridges 74 is cam-shaped, so that its upper end 76 engages more closely toward a wall or crossbar 78 of the frame 66 than does its lower end 80, the end of the buckle being seen in dashed lines in FIG. 6. The strap is thus more and more tightly engaged between the lever 68 and the wall or crossbar 78 of the frame 66 as the tensioned part 20*b* of the strap is pulled more tightly. Conversely, when the strap tail 28*a* is pulled, this rotates the camming lever 68 in the counterclockwise direction, loosening the cam's force on the strap and allowing the strap tail to be pulled relatively easily.

As in other embodiments of buckles described above, the cam lock buckle 65 has a hole 82 in the tail end of the frame or base 66, for anchoring to the snowshoe webbing or to an anchor strap.

The above described preferred embodiments are intended to illustrate the principles of the invention, but not to limit its scope. Other embodiments and variations to this preferred embodiment will be apparent to those skilled in the art and may be made without departing from the spirit and scope of the invention.

We claim:

1. In a snowshoe having a harness with webbing straps and with provision for tightening the straps over a user's boot, the improvement comprising:

at least one buckle on the webbing straps of the harness, the buckle being connected at one end to the harness and having a second end through which passes a webbing strap to be tightened, with the webbing strap being doubled back through the buckle to provide a tail of the strap for gripping and pulling to tighten a tensioned portion of the strap leading to the buckle, the buckle being a cam lock buckle of the type having a spring loaded, pivoted lever with engagement teeth on a lower side positioned to engage against the tail end of the webbing strap, the buckle including a cross bar toward which the teeth of the lever are urged such that the tail end of the strap passes between the teeth and the bar, the spring loaded pivoted lever and the teeth being so positioned and oriented that the tail end of the webbing strap can be pulled through the second end of the buckle freely, forcing the lever to pivot in the direction away from the surface of the strap tail end against the spring force while the tensioned portion of the webbing strap is pulled tighter to tighten the harness, and such that when pulling force on the tail end of the strap is discontinued, back-pulling force from the tensioned portion of the strap tends to draw the lever in pivotal rotation more tightly against the strap tail, biting the teeth into the surface of the strap more firmly and thus positively gripping the webbing strap in the buckle and preventing slipping, wherein the buckle has a frame supporting the lever, with a pivot pin connecting said lever pivotally on the frame, said cross bar being supported on the frame, and the frame being of molded plastic.

2. The apparatus defined in claim 1, wherein the buckle has a direction reversal pin adjacent to and spaced from the spring loaded pivoted lever, between the lever and said one end of the buckle, the webbing strap passing around and over the reversal pin and doubling back such that the tail end of the strap passes between the lever and the cross bar, the reversal pin having a low-friction surface relative to the webbing strap.

3. The apparatus defined in claim 1, wherein said one end of the buckle is directly connected to the harness, without any strap between the harness and said one end.

4. The apparatus defined in claim 3, wherein said one end of the buckle is connected to the harness by riveting.

5. The apparatus defined in claim 1, wherein the spring loaded pivoted lever has a generally nautilus-shaped hub in relation to a pivot axis on which the hub of the lever is pivoted, varying in radius from the axis such that the hub of the lever about the axis comes closer to the bar as the lever pivots down toward the cross bar, the teeth being on a portion of the hub at a location of largest radius from the axis.

6. The apparatus defined in claim 1, wherein the engagement teeth of the pivoted lever comprise at least one lateral ridge on the lever positioned to engage against the strap such that the ridge is transverse to the length of the strap.

7. A buckle for use in tightening a webbing strap in a configuration wherein the webbing strap doubles back at the buckle so that a tail end of the webbing strap is pulled through the buckle to tighten the strap, comprising:

a buckle frame with a first end adapted for connection to an item to be pulled tight and a second end adapted for engagement with a webbing strap to pass through the buckle and double back, a webbing strap having a tension portion extending in a direction opposite said one end and passing through the buckle and extending out of the buckle in doubled-back fashion such that a tail of the strap is positioned to be pulled by a user for tightening tension portion of the strap, the frame having a direction reversal pin over which the strap is doubled, the pin having a low-friction surface such that the strap slides easily over the pin, and the pin being between said first and second ends of the buckle frame, the buckle being a cam lock buckle of the type having a spring loaded, pivoted lever with engagement teeth on a lower side positioned to engage against the tail end of the webbing strap, the pivoted lever being connected to the second end of the buckle frame, the buckle frame including a crossbar at the second end, toward which the teeth of the lever are urged such that the tail end of the strap passes between the teeth and the bar, the spring loaded pivoted lever and the teeth being so positioned that the tail end of the webbing strap can be pulled to the second end of the buckle freely, forcing the lever to pivot away from the surface of the strap tail against the spring force while the tension portion of the webbing strap is pulled tighter, and such that when pulling force on the tail of the strap is discontinued, back-pulling force from the tension portion of the strap tends to draw the lever more tightly against the strap tail, biting the teeth into the surface of the strap more firmly and thus positively gripping the webbing strap in the buckle and preventing slipping.

* * * * *